US007549475B2

(12) United States Patent
Tjorswaag et al.

(10) Patent No.: US 7,549,475 B2
(45) Date of Patent: Jun. 23, 2009

(54) SYSTEMS FOR ACTUATING A DOWNHOLE TOOL

(75) Inventors: Thor Tjorswaag, Tananger (NO); Henry E. Rogers, Duncan, OK (US); Nichalos C. Braun, Duncan, OK (US); Brett Fears, Duncan, OK (US); Stein Olaussen, Tanager (NO)

(73) Assignee: Halliburton Energy Services, Inc., Duncan, OK (US)

( * ) Notice: Subject to any disclaimer, the term of this patent is extended or adjusted under 35 U.S.C. 154(b) by 207 days.

(21) Appl. No.: 11/674,022

(22) Filed: Feb. 12, 2007

(65) Prior Publication Data

US 2008/0190611 A1 Aug. 14, 2008

(51) Int. Cl.
*E21B 33/13* (2006.01)

(52) U.S. Cl. ..... 166/291; 166/177.4

(58) Field of Classification Search ..... 166/285, 166/291, 177.4, 75.15
See application file for complete search history.

(56) References Cited

U.S. PATENT DOCUMENTS

| | | | |
|---|---|---|---|
| 2,961,046 | A | 11/1960 | Moeller et al. |
| 2,981,335 | A | 4/1961 | Bucy et al. |
| 3,003,560 | A | 10/1961 | Corley, Jr. et al. |
| 3,028,996 | A | 4/1962 | Ellett |
| 3,091,294 | A | 5/1963 | Evans et al. |
| 3,130,783 | A | 4/1964 | Orr |
| 3,403,729 | A | 10/1968 | Hickey |
| 3,665,954 | A | 5/1972 | McNeal et al. |
| 4,418,756 | A | 12/1983 | Yonker et al. |
| 4,435,872 | A | 3/1984 | Leikam |
| 5,004,048 | A | 4/1991 | Bode |
| 5,095,988 | A | 3/1992 | Bode |
| 5,709,266 | A | 1/1998 | Kruse |
| 5,758,726 | A | 6/1998 | Streich et al. |
| 6,139,644 | A | 10/2000 | Lima |
| 6,318,472 | B1 | 11/2001 | Rogers et al. |
| 6,336,238 | B1 | 1/2002 | Tarlton |
| 6,575,247 | B2 | 6/2003 | Tolman et al. |
| 6,796,377 | B2 | 9/2004 | Butterfield, Jr. et al. |
| 6,810,958 | B2 | 11/2004 | Szarka et al. |

(Continued)

FOREIGN PATENT DOCUMENTS

EP 0 837 216 A2 4/1998

(Continued)

OTHER PUBLICATIONS

Smith Services Completion Systems; "Maintenance and Operating Manual for CMIB Top Drive Manifold & CMIB Top Drive Swivel," Smith International, Inc., 2003, 15 pgs.

(Continued)

*Primary Examiner*—William P Neuder
(74) *Attorney, Agent, or Firm*—John W. Wustenberg; Conley Rose, P.C.

(57) ABSTRACT

A system for actuating a downhole tool disposed within a work string comprising a support suspending the work string into a well bore, a launching apparatus positioned at a location remote from the work string, a tortuous path connected between the launching apparatus and the work string, and a mechanical plug that launches from the launching apparatus, traverses the tortuous path, enters the work string, and actuates the downhole tool.

32 Claims, 5 Drawing Sheets

U.S. PATENT DOCUMENTS

| | | | | |
|---|---|---|---|---|
| 6,868,906 | B1 | 3/2005 | Vail, III et al. | |
| 6,904,970 | B2 * | 6/2005 | Simson | 166/291 |
| 6,973,966 | B2 | 12/2005 | Szarka | |
| 7,080,687 | B2 | 7/2006 | Butterfield, Jr. et al. | |
| 7,255,162 | B2 | 8/2007 | Stevens et al. | |
| 7,325,606 | B1 | 2/2008 | Vail, III et al. | |
| 7,426,963 | B2 | 9/2008 | O'Neill | |
| 7,428,927 | B2 | 9/2008 | Vert et al. | |
| 2002/0100590 | A1 | 8/2002 | De Almeida | |
| 2005/0183857 | A1 | 8/2005 | Rogers et al. | |
| 2006/0283593 | A1 | 12/2006 | Robichaux et al. | |
| 2007/0012448 | A1 | 1/2007 | Rogers et al. | |
| 2008/0067810 | A1 * | 3/2008 | Peer et al. | 285/272 |
| 2008/0190613 | A1 * | 8/2008 | Tjorswaag et al. | 166/289 |
| 2008/0230224 | A1 | 9/2008 | Angman | |

FOREIGN PATENT DOCUMENTS

| | | | |
|---|---|---|---|
| EP | 1 340 882 | A2 | 9/2003 |
| WO | WO 2005/090740 | A1 | 9/2005 |

OTHER PUBLICATIONS

Halliburton; "Casing Sales Manual—Your Source for Cementing Casing Equipment Information," May 2004, 4 pgs.

Weatherford; "TDH Top Drive Cementing Head," www.weatherford.com, 2001, 1 pg.

Foreign communication related to a counterpart application dated Jul. 21, 2008.

Office Action dated Dec. 17, 2008 (15 pages), U.S. Appl. No. 11/674,020, filed Feb. 12, 2007.

* cited by examiner

SYSTEMS FOR ACTUATING A DOWNHOLE TOOL

CROSS-REFERENCE TO RELATED APPLICATIONS

The subject matter of the present application is related to U.S. patent application Ser. No. 11/674,020 filed Feb. 12, 2007 and entitled "Methods for Actuating a Downhole Tool," which is hereby incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to apparatus and methods of releasing mechanical plugs into a well bore. More particularly, the present invention relates to compressible mechanical plugs that may be released into a work string disposed within a well bore to actuate downhole tools, and methods of releasing the mechanical plugs remotely from the work string.

BACKGROUND

In general, when drilling hydrocarbon wells, a drill bit is disposed at the end of a drill string, and typically, the drill string is rotated from the surface utilizing either a top drive unit or a rotary table set in the drilling rig floor. As drilling progresses, increasingly smaller diameter tubulars comprising casing and/or liner strings may be installed end-to-end to line the borehole wall. As the well is drilled deeper, each string is run through and secured to the lower end of the previous string to line the borehole wall. Finally, the string is cemented into place by flowing cement down the flowbore of the string and up the annulus formed by the string and the borehole wall.

To perform the cementing operation, a cementing manifold is usually disposed between the top drive unit or rotary table and a work string extending into the well. Due to its position, the cementing manifold must suspend the weight of the work string and the casing string, contain pressure, transmit torque, and allow unimpeded rotation of the work string. The cementing manifold is designed to allow fluids, such as drilling mud or cement, to flow therethrough while simultaneously enclosing and protecting from flow one or more darts that are released on demand and in sequence to perform various operations downhole, including wiping pipe surfaces, separating fluids, and actuating downhole tools. Thus, as fluid flows through the cementing manifold, the darts are isolated from the fluid flow until they are ready for release.

Within the borehole, the work string, with one or more cementing plugs disposed at a lower end thereof, extends into and connects to a casing running tool that suspends the casing string to be cemented. Thus, the work string is positioned upstream of the casing string. The work string runs the casing string into the borehole to the desired depth, and the casing string fills with drilling fluid or other fluid in the well as it is being run in. When the casing string is positioned at the desired depth, cement is pumped downhole through the work string. As the cement is pumped, a dart or other device is released from the cementing manifold and propelled down the work string ahead of the batch of cement. The dart lands in a seat in one of the cementing plugs at the lower end of the work string, and the pressure behind the dart causes the cementing plug to be released as the cement pushes the plug down. Thus, the cementing plug is released by the dart ahead of the cement batch. This cementing plug maintains a separation between the cement slurry and the drilling fluid, and thereby reduces contamination of the cement slurry as it flows into the casing string. The cementing plug that precedes the cement slurry and separates it from the drilling fluid is referred to herein as the "bottom cementing plug." This bottom cementing plug also sealingly engages the inner surface of the casing string to wipe the drilling fluid from the walls of the casing string ahead of the cement slurry. The bottom cementing plug then lands on a float collar or float shoe attached within the bottom end of the casing string.

When the bottom cementing plug lands on the float collar or float shoe attached to the bottom of the casing string, a bypass mechanism in the bottom cementing plug is actuated to allow the cement slurry to proceed through the bottom cementing plug, through the float collar or float shoe and upwardly into the well bore annulus between the casing string and the borehole wall. When the required quantity of cement slurry has been pumped through the work string, a second dart or other device is launched from the cementing manifold to follow the cement batch. This dart is pushed along by a displacement fluid and wipes cement from the walls of the work string, then lands in a releasing sleeve of a second cementing plug at the lower end of the work string. The second cementing plug, referred to herein as the "top cementing plug", is thereby released from the work string to separate the cement slurry from additional drilling fluid or other fluid used to displace the cement slurry through the casing string. The design of the top cementing plug is such that when it lands on the bottom cementing plug at the lower end of the casing string, it shuts off fluid flow through both the top and bottom cementing plugs, which prevents the displacement fluid from entering the well bore annulus.

The traditional cementing method described above involves a cementing manifold that comprises an integral part of the work string, thus requiring field personnel to work in close proximity to the work string to manually release darts during cementing operations. When operating from a drilling platform, for example, field personnel may be wenched into a harness and suspended from a derrick within reach of the cementing manifold so that such personnel may manually manipulate valves to release darts into the work string at desired times. This manual method of releasing darts creates the risk of injury to field personnel, especially when operating from an offshore floating platform, for example, where wind and waves create additional hazards to personnel suspended in a harness. Therefore, such manual methods of releasing darts from conventional cementing manifolds are not permitted in some countries, such as Norway, for example. Thus, an alternative method of releasing darts from the cementing manifold was developed wherein the cementing manifold valves are remotely actuated rather than manually actuated. Although such remote actuation methods address the concern about field personnel working in close proximity to the work string, the cementing manifold must still be capable of suspending the weight of the work string and casing string, containing pressure, transmitting torque, and rotating the work string. In addition, remote actuation of the cementing manifold valves to release darts adds complexity to the system, and therefore more cost and less reliability as compared to the traditional manual method using field personnel to manipulate the valves.

Thus, a need exists for apparatus and methods to remotely release actuating, wiping, and/or separating devices, such as mechanical plugs, into the work string during cementing operations, while reducing design complexity of the cementing manifold, reducing manufacturing costs, and increasing operational reliability.

SUMMARY OF THE INVENTION

Disclosed herein is a system for actuating a downhole tool disposed within a work string comprising a support suspending the work string into a well bore, a launching apparatus positioned at a location remote from the work string, a tortuous path connected between the launching apparatus and the work string, and a mechanical plug that launches from the launching apparatus, traverses the tortuous path, enters the work string, and actuates the downhole tool.

BRIEF DESCRIPTION OF THE DRAWINGS

For a more detailed description of the present invention, reference will now be made to the accompanying drawings, wherein.

NOTATION AND NOMENCLATURE

Figure 1:
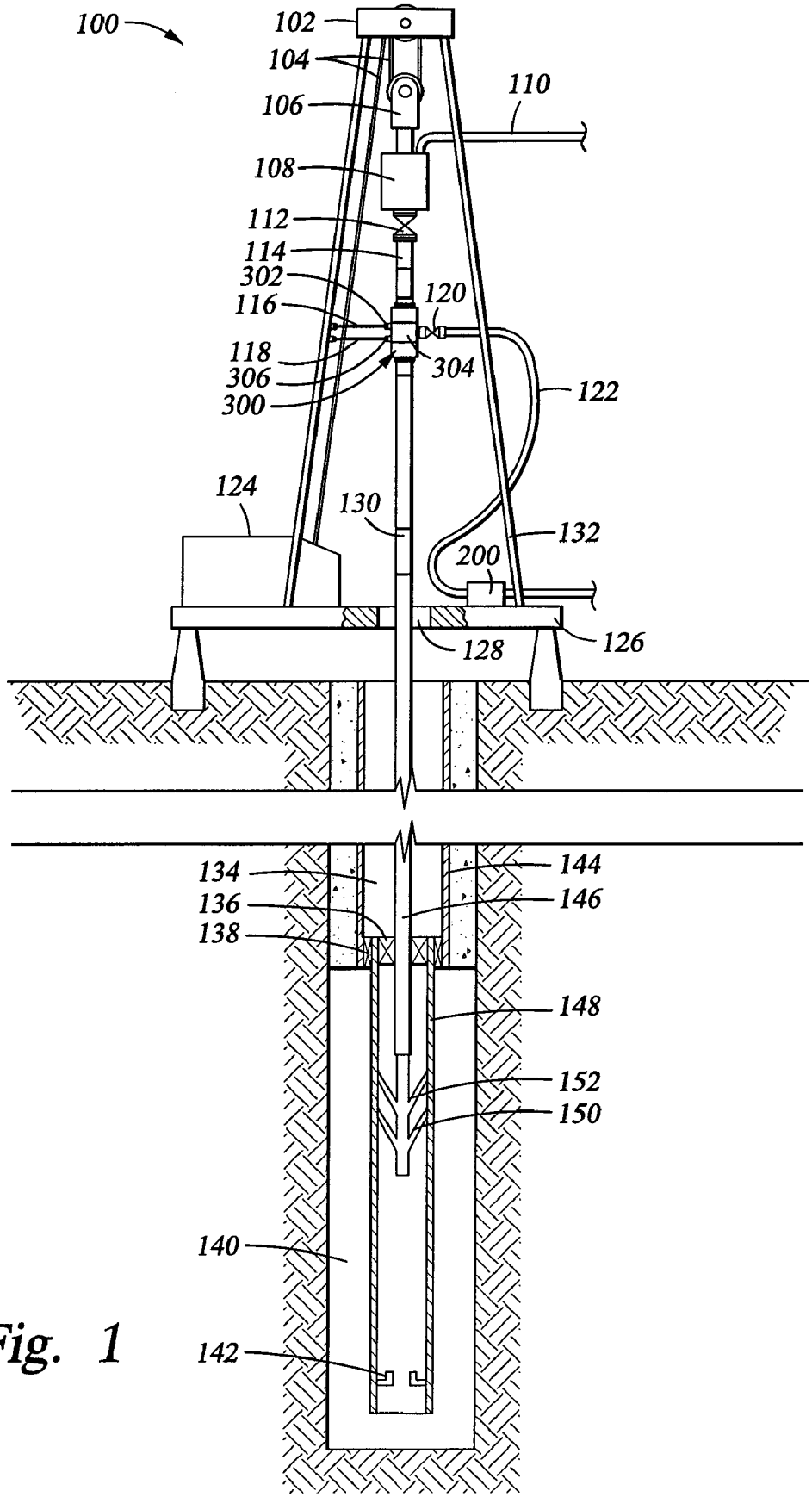
FIG. 1 schematically depicts a representative cementing operation in which a remote launching apparatus may be utilized instead of a conventional cementing manifold disposed in the work string.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

DETAILED DESCRIPTION

A remote launching apparatus and mechanical plugs that may be released into a work string to actuate downhole tools will now be described with reference to the accompanying drawings, wherein like reference numerals are used for like features throughout the several views. There is shown in the drawings, and herein will be described in detail, one embodiment of a remote launching apparatus and two embodiments of mechanical plugs with the understanding that this disclosure is representative only and is not intended to limit the invention to the specific embodiments illustrated and described herein. One skilled in the art will readily appreciate that the remote launching apparatus is not limited to a design that launches any particular number of devices, but may be designed to launch one, two, or more devices, such as mechanical plugs. Moreover, one skilled in the art will understand that the mechanical plugs are not limited to the shapes disclosed herein but may assume many other shapes. Furthermore, the embodiments of the apparatus and methods disclosed herein may be used not only in a cementing operation, but in any well bore operation.

FIG. 1 schematically depicts a representative cementing system in which a remote launching apparatus 200 may be utilized. A drilling rig 100 is depicted that includes a derrick 132 with a rig floor 126 at its lower end having an opening 128 through which a work string 146 extends downwardly into a well bore 134. The work string 146 may be driven rotatably by a top drive drilling unit 108 that is suspended from the derrick 132 by a traveling block 106. The traveling block 106 is supported and moveable upwardly and downwardly by cabling 104 connected at its upper end to a crown block 102 and actuated by conventional powered draw works 124. Connected below the top drive unit 108 is a kelly valve 112, a pup joint 114, and a cementing swivel 300. A flag sub 130, which provides a visual indication when a mechanical plug passes therethrough, is connected below the cementing swivel 300 and above the work string 146. A drilling fluid line 110 routes drilling fluid to the top drive unit 108. A fluid delivery line 122 routes drilling fluid, cement, and/or displacement fluid from a remote launching apparatus 200 located on the rig floor 126 to a valve 120 connecting between the fluid delivery line 122 and the cementing swivel 300.

In the cementing operation shown in FIG. 1, the remote launching apparatus 200 replaces the standard cementing manifold that is typically disposed between the swivel 300 and the work string 146 to form an integral part of the system supporting the weight of the work string 146 extending into the well bore 134. As illustrated in FIG. 1, the launching apparatus 200 is positioned at a location remote from the work string 146, such as the rig floor 126, for example, which may be some distance away from the work string 146. Thus, in contrast to a standard cementing manifold, the launching apparatus 200 is not positioned in substantial vertical alignment with the work string 146 to form an integral part thereof, and the launching apparatus 200 is also not load bearing, nor does it support the weight of the work string 146, nor does it transmit torque, nor does it rotate the work string 146. Operationally, by positioning the launching apparatus 200 remotely from the work string 146 (e.g. on the rig floor 126) operating personnel may manually release mechanical plugs from the launching apparatus 200 without working in close proximity to the work string 146 and without being suspended from a harness connected to the derrick 132. One skilled in the art will readily appreciate that the remote launching apparatus 200 may be positioned at any desired location remote from the work string 146 to provide safe and convenient access to operating personnel.

While the representative cementing operation of FIG. 1 depicts a stationary drilling rig 100, one of ordinary skill in the art will readily appreciate that such cementing operations may also be conducted from mobile workover rigs, well servicing units, and the like. In addition, while the representative cementing operation of FIG. 1 depicts a land-based environment, one of ordinary skill in the art will readily appreciate that such cementing operations may also be conducted from an offshore platform in connection with a subsea well bore. Further, while FIG. 1 and the description that follows refers to a cementing operation, one of ordinary skill in the art will understand that the apparatus and methods disclosed herein are equally applicable for use in other operations to actuate downhole tools.

Figure 2A:
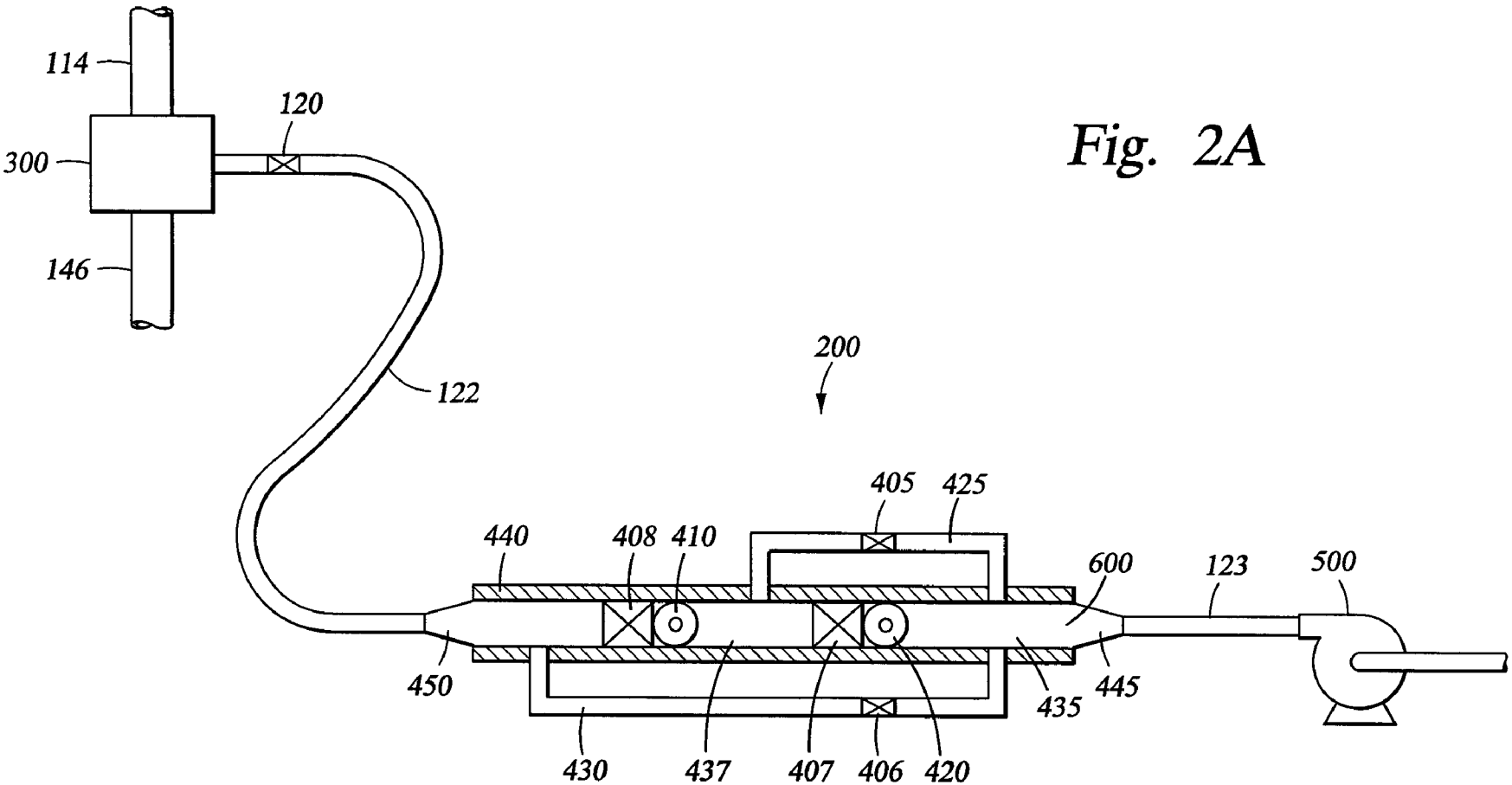
FIG. 2A is a cross-sectional view of one representative remote launching apparatus, wherein mechanical plug reloading preempts fluid flow through the remote launching apparatus.

Referring now to FIG. 2A, one embodiment of a remote launching apparatus 200 configured to release two mechanical plugs 410, 420 is depicted. The remote launching apparatus 200 comprises a housing 440, an inlet port 445, an outlet port 450, a throughbore 435 with a first launching valve 408 and a second launching valve 407 disposed therein, a first by-pass loop 425 with a first by-pass valve 405, and a second by-pass loop 430 with a second by-pass valve 406. A fluid supply line 123 is connected between a supply pump 500 and the remote launching apparatus 200 at the inlet port 445, and the fluid delivery line 122 is connected between the remote launching apparatus 200 at the outlet port 450 and the valve 120 connected to the cementing swivel 300.

In operation, fluid 600 is conveyed by the supply pump 500 through the fluid supply line 123 into the inlet 445 of the remote launching apparatus 200. Depending upon the positions of valves 405, 406, 407, and 408, the fluid 600 then flows through the remote launching apparatus 200 along one or more of three paths: the throughbore 435, the first by-pass loop 425, and/or the second by-pass loop 430. The fluid 600 then exits the remote launching apparatus 200 at the outlet port 450 where it flows through the fluid delivery line 122 towards the cementing swivel 300. Two mechanical plugs 410, 420 are shown positioned within the throughbore 435 of the remote launching apparatus for release into the flowing fluid 600. These mechanical plugs 410, 420 may be released and transported by the fluid 600 to the work string 146 through manipulation of valves 405, 406, 407 and 408, either manually by field personnel, or by automated means. The mechanical plugs 410, 420 may be released either one at a time or simultaneously. Further, the dual mechanical plug configuration of the remote launching apparatus 200 shown in FIG. 2A may be reconfigured to accommodate a single mechanical plug or a plurality of mechanical plugs. To ease the process of reconfiguration, in an embodiment, all of the valves 405, 406, 407, and 408 are identical and interchangeable.

Figure 2B:
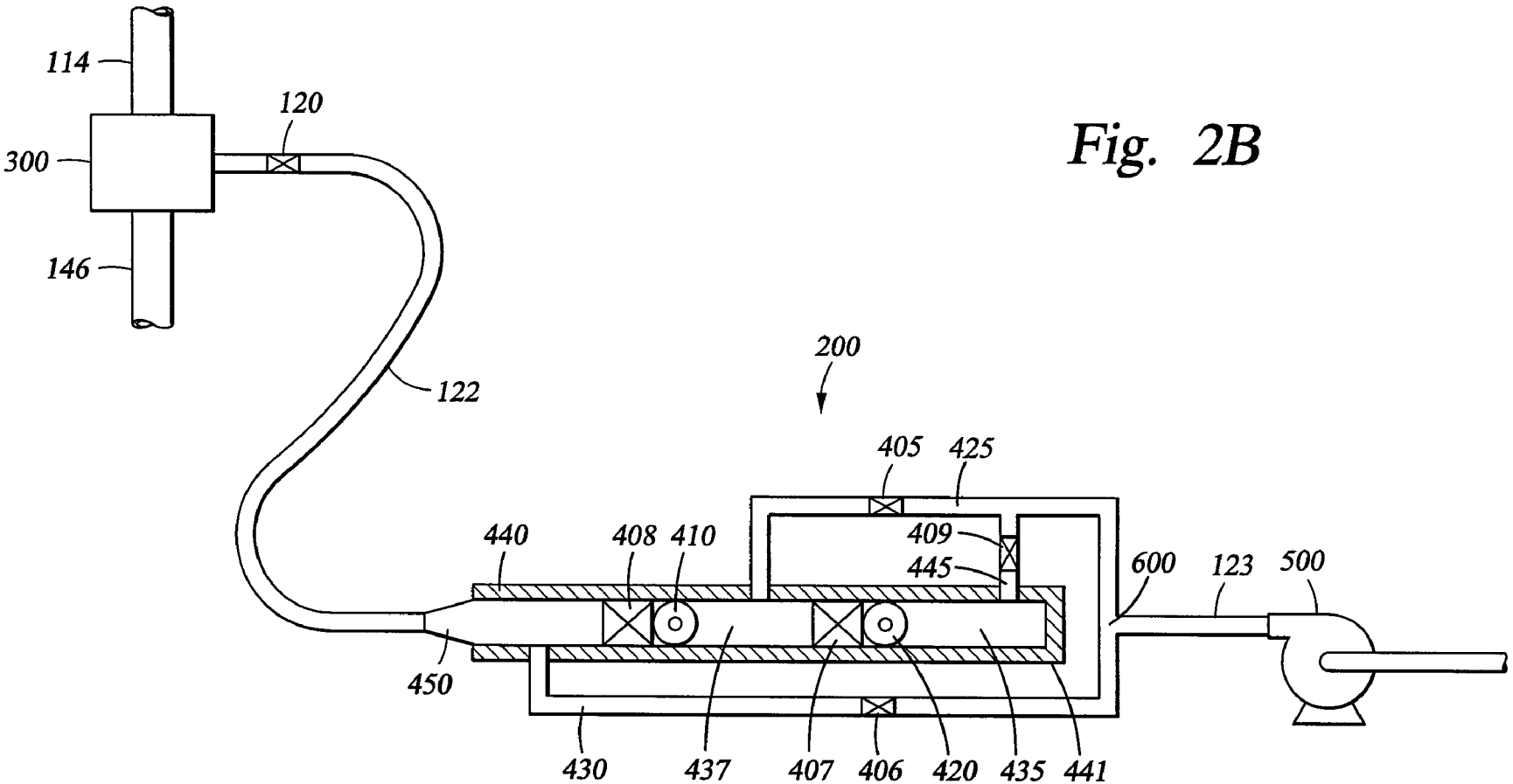
FIG. 2B is a cross-sectional view of one representative remote launching apparatus, wherein mechanical plugs may be reloaded while fluid continues to flow through the remote launching apparatus.

In an alternative embodiment, as depicted in FIG. 2B, valves 405, 406, 407, 408, and the third by-pass valve 409, the access cap 441, and by-pass loops 425, 430 allow for either or both mechanical plugs 410, 420 to be reloaded while the fluid 600 continues flowing through the remote launching apparatus 200 such that additional mechanical plugs may be launched from the dual mechanical plug configuration. For example, the first mechanical plug 410 and the second mechanical plug 420 may be launched either sequentially or simultaneously, then another first mechanical plug 410 and/or another second mechanical plug 420 may be loaded and launched, all while flowing fluid 600 through the launching apparatus 200. As one of ordinary skill in the art will readily appreciate, many other variations are possible.

Figure 3:
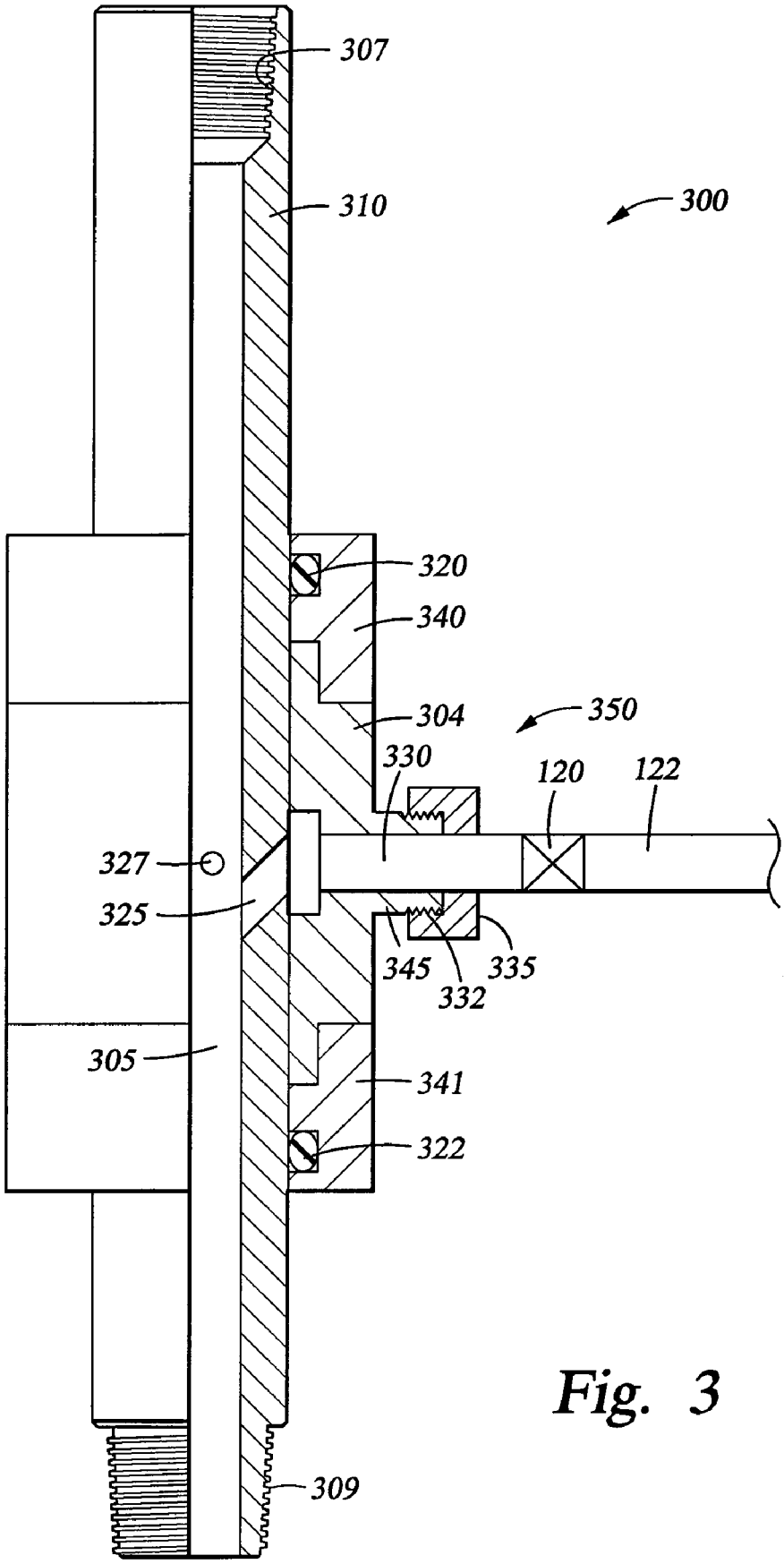
FIG. 3 is a cross-sectional view of one representative cementing swivel.

Turning now to FIG. 3, one embodiment of a cementing swivel 300 is shown in cross-sectional side view. The cementing swivel 300 comprises a tubular mandrel 310, a housing 304, upper cap 340 and lower cap 341, with upper and lower sealing assemblies 320, 322, respectively, disposed above and below a fluid channel 325 in the mandrel 310, and between the mandrel 310 and the caps 340, 341. The cementing swivel 300 also comprises a fluid delivery line connection 350 and tie-off connections 302, 306 (shown in FIG. 1). Tubular mandrel 310 comprises a throughbore 305, the fluid channel 325, a plurality of fluid apertures 327, an upper threaded connection 307 for connecting the mandrel 310 to the top drive unit 108, and a lower threaded connection 309 for connecting the mandrel 310 to the work string 146. The housing 304 comprises one or more radially projecting integral conduits 345 with a fluid port 330 extending through both the integral conduit 345 and the housing 304. The integral conduit 345 forms a threaded connection 332 with a connector 335 on the end of the fluid delivery line 122. When the tubular mandrel 310 is rotationally positioned as shown in FIG. 3, the fluid port 330 extends between the fluid delivery line 122 and the fluid channel 325, which is in fluid communication with the mandrel throughbore 305. The fluid channel 325 within the mandrel 310 may be angled so that as fluid 600 flows through the fluid connection 350, it enters the throughbore 305 of the mandrel 310 generally in the downwardly direction. This allows the fluid 600 to impinge on the wall of the throughbore 305 at an angle to minimize erosion of the fluid channel 325 and the mandrel 310. When the tubular mandrel 310 is rotationally positioned such that the fluid channel 325 is out of alignment with the fluid port 330, then fluid communication is provided between the fluid port 330 and the throughbore 305 of the mandrel via fluid apertures 327.

Referring again to FIGS. 1-3, during normal operation, drilling fluid flows through drilling fluid line 110 down into the work string 146 while the top drive unit 108 rotates the work string 146. The housing 304 of the cementing swivel 300 is tied-off to the derrick 132 via lines or bars 116, 118 connected to tie-off connections 302, 306 such that the swivel housing 304 cannot rotate and remains stationary while the mandrel 310 of the swivel 300 rotates within the housing 304 to enable the top drive unit 108 to rotate the work string 146.

Many different operations may be performed by launching one or more mechanical plugs 410, 420 from the remote launching apparatus 200, through the swivel 300, and into the work string 146 to actuate one or more downhole tools. One such operation comprises actuating a liner hanger 138 to suspend a new casing string 148 from existing and previously cemented casing 144. To perform this operation, the first mechanical plug 410 may be released from the remote launching apparatus 200 as will be described in more detail herein. In this case, the mechanical plug 410 is launched by pumping drilling fluid 600 via supply pump 500 for delivery through fluid delivery line 122. Before releasing the first mechanical plug 410, the top drive unit 108 is deactivated so that the mandrel 310 inside the cementing swivel 300 ceases to rotate. In an embodiment, the cementing swivel 300 comprises a locking mechanism (not shown) that enables the mandrel 310 to be locked into a position where the fluid channel 325 and the fluid port 330 align to maintain a flowpath through which the first mechanical plug 410 may pass as it travels through the cementing swivel 300 and into the work string 146. After the first mechanical plug 410 passes through the cementing swivel 300 and down the work string 146 past the flag sub 130, the mandrel 310 may be unlocked, and the top drive unit 108 reactivated to resume rotating the work string 146. As the mandrel 310 is rotating, drilling fluid may be supplied through the drilling fluid line 110, or through the fluid delivery line 122 via the fluid apertures 327 in the mandrel 310.

To begin the cementing operation, the remote launching apparatus 200 is first reloaded with another first mechanical plug 410 so that both mechanical plugs 410 and 420 may be launched during cementing. As will be described in more detail below, the embodiment of the remote launching apparatus 200 depicted in FIG. 2A does not allow for the reloading of mechanical plugs 410 and 420 while fluid 600 continues to flow through the apparatus 200, whereas the embodiment of the remote launching apparatus 200 depicted in FIG. 2B allows for the dynamic reloading of mechanical plugs 410 and 420 while fluid 600 continues to flow through the apparatus 200.

As depicted in FIG. 2A, the flow of fluid 600 delivered by the supply pump 500 to the remote launching apparatus 200 must be preempted to allow for the reloading of mechanical plugs 410 and 420 into the remote launching apparatus 200 via ingress through the inlet port 445.

As shown in FIG. 2B, the flow of fluid 600 may continue to be delivered by the supply pump 500 to the remote launching apparatus 200 while a first mechanical plug 410 and/or a second mechanical plug 420 are loaded into the remote launching apparatus 200. The first mechanical plug 410 may be loaded while fluid 600 continues to flow through the remote launching apparatus 200 via the second by-pass loop 430 by opening the second by-pass valve 406, closing valves 405, 408 and 409, opening the second launch valve 407, and accessing space 437 to load another first mechanical plug 410 via removal of access cap 441. The second mechanical plug 420 may then be loaded while fluid 600 continues to flow through the remote launching apparatus 200 via the second by-pass loop 430 by continuing to keep second by-pass valve 406 open while valves 405, 408, and 409 remain closed and by closing second launch valve 407 and inserting the second mechanical plug 420 into space 435 through the opening created by the removal of access cap 441.

With the remote launching apparatus 200 loaded with mechanical plugs 410, 420, the cementing operation can commence. The kelly valve 112 is closed to block off the drilling fluid line 110, and the delivery valve 120 to the fluid delivery line 122 is opened, thereby opening a pathway for the first mechanical plug 410 propelled by the fluid 600, in this case cement, to flow through the swivel 300 and down into the work string 146. Again, the top drive unit 108 is deactivated and the mandrel 310 of the cementing swivel 300 is aligned and locked in place until the first mechanical plug 410 passes through. Downhole, the first mechanical plug 410 actuates the bottom cementing plug 150, which releases to land on the float collar 142 at the bottom of tubular 148. Thereafter, it is preferable to rotate the work string 146 during cementing to ensure that cement is distributed evenly around the new casing string 148 downhole. More specifically, because the cement is a thick slurry, it tends to follow the path of least resistance. Therefore, if the new casing string 148 is not centered in the well bore 140, the annular area 140 will not be symmetrical, and cement may not completely surround the tubular 148. Thus, in an embodiment, the mandrel 310 is unlocked and the top drive unit 108 is reactivated to continue rotating the work string 146 through the cementing swivel 300 while cement 600 is introduced from the fluid delivery line 122 into the throughbore 305 of the mandrel 310 via fluid apertures 327.

Referring to FIG. 2A, to launch the first mechanical plug 410, the second launch valve 407 and second by-pass valve 406 are closed and first launch valve 408 and first by-pass valve 405 are opened. While the supply pump 500 pumps fluid 600, namely cement, through the fluid supply line 123 into the remote launching apparatus 200, the cement 600 is forced to flow into the first by-pass loop 425 where the first by-pass valve 405 is open to permit the cement 600 to flow into the portion 437 of the throughbore 435 behind the first mechanical plug 410. The first mechanical plug 410 is pumped ahead of the cement 600 as the cement 600 exits the remote launching apparatus 200 at the outlet 450 and flows towards the cementing swivel 300 carrying the first mechanical plug 410 along with it. Thus, the first mechanical plug 410 separates the drilling fluid already in the work string 146 from the cement 600 that follows. After the first mechanical plug 410 has been released, the first by-pass valve 405 may be closed and the second by-pass valve 406 may be opened, thereby causing the cement 600 to flow through the second by-pass loop 430.

Referring to FIG. 2B, to launch the first mechanical plug 410, second launch valve 407, second by-pass valve 406, and third by-pass valve 409 are closed, and first launch valve 408 and first by-pass valve 405 are opened. While the supply pump 500 pumps fluid 600, namely cement, through the fluid supply line 123 into the remote launching apparatus 200, the cement 600 is forced to flow into the first by-pass loop 425 where the first by-pass valve 405 is open to permit the cement 600 to flow into the portion 437 of the throughbore 435 behind the first mechanical plug 410. The first mechanical plug 410 is pumped ahead of the cement 600 as the cement 600 exits the remote launching apparatus 200 at the outlet 450 and flows towards the cementing swivel 300 carrying the first mechanical plug 410 along with it. Thus, the first mechanical plug 410 separates the drilling fluid already in the work string 146 from the cement 600 that follows. After the first mechanical plug 410 has been released, the first by-pass valve 405 may be closed and the second by-pass valve 406 may be opened, thereby causing the cement 600 to flow through the second by-pass loop 430.

When the appropriate volume of cement has been pumped into the work string 146, a second mechanical plug 420 may be released from the remote launching apparatus 200 to wipe cement from the inner wall of the tubular 148 and launch the top cementing plug 152 to land on the bottom cementing plug 150 disposed on the float collar 142. Before the second mechanical plug 420 is released from the remote launching apparatus 200, the top drive unit 108 is again deactivated, and the mandrel 310 inside the cementing swivel 300 is aligned and locked into position so that the fluid channel 325 and the fluid port 330 align. This opens a flowpath through which the second mechanical plug 420 may pass as it travels through the cementing swivel 300 and into the work string 146. In one embodiment, the second mechanical plug 420 is propelled by drilling fluid. Once the second mechanical plug 420 has passed through the cementing swivel 300, the mandrel 310 may be unlocked and the top drive 108 reactivated to resume rotating the work string 146 and continue supplying drilling fluid, either through the drilling fluid line 110, or through the fluid supply line 122 and into the throughbore 305 of the swivel 300 via fluid apertures 327 in the mandrel 310. To resume normal operations, the delivery valve 120 to the fluid delivery line 122 is closed, and the kelly valve 112 to the drilling fluid line 110 is opened to supply drilling fluid to the work string 146.

Referring to FIG. 2A, to release the second mechanical plug 420, the first by-pass valve 405 is closed, the second by-pass valve 406 is closed, the first launching valve 408 is opened, and the second launching valve 407 is opened, forcing the fluid 600, in this case displacement fluid, to travel along the throughbore 435 of the remote launching apparatus 200. As the displacement fluid 600 flows along this path and exits the remote launching apparatus 200, it propels second mechanical plug 420 ahead of it. Thus, the displacement fluid 600 that flows into the work string 146 follows the second mechanical plug 420 and is thereby separated from the cement by the second mechanical plug 420.

Referring to FIG. 2B, to release the second mechanical plug 420, the first by-pass valve 405 is closed, the second by-pass valve 406 is closed, the third by-pass valve 409 is opened, the first launching valve 408 is opened, and the second launching valve 407 is opened, forcing the fluid 600, in this case displacement fluid, to travel along the throughbore 435 of the remote launching apparatus 200. As the displacement fluid 600 flows along this path and exits the remote launching apparatus 200, it propels second mechanical plug 420 ahead of it. Thus, the displacement fluid 600 that flows into the work string 146 follows the second mechanical plug 420 and is thereby separated from the cement by the second mechanical plug 420.

As stated previously, the remote launching apparatus 200 may be positioned on the rig floor 126 or another location remote from the work string 146, thus allowing manual release of mechanical plugs 410, 420 by field personnel without placing those personnel in close proximity to the work string 146, and without requiring such personnel to be suspended from a harness connected to the derrick 132, for example. Also, by locating the launching apparatus 200 remote from the work string 146, it need not be designed to handle the weight of the work string 146 and the casing string 148, nor to transmit torque, nor to allow rotation therethrough. Positioning the launching apparatus 200 remotely from the work string 146 does, however, necessitate a different design for the mechanical plugs 410, 420 as compared to traditional darts used to wipe pipe surfaces, separate fluids, and/or actuate downhole tools.

Because conventional cementing methods use a cementing manifold installed in substantial vertical alignment with the work string 146 to form an integral part thereof, the darts released from a conventional cementing manifold are designed for travel along an essentially straight path downwardly through the work string 146. Such conventional darts are not designed to traverse a tortuous path, such as the flowpath provided by the fluid delivery line 122 between the remote launching apparatus 200 and the swivel 300. As shown in FIG. 1, to connect between the launching apparatus 200 on the rig floor 126 and the swivel 300 suspended from the derrick 132, the fluid delivery line 122 presents a tortuous path that includes changes in elevation and a variety of constrictions, such as corners, bends, valves, pipe diameter changes, flange connections, orifices, and the like. Because conventional darts are designed for essentially straight-path travel, these conventional darts are not suited for traversing such a tortuous path become they may become stuck and/or damaged due to the changing elevations, the changing directions, and the various constrictions in the flow path.

Thus, in contrast to conventional darts that only travel along an essentially straight-line path, the mechanical plugs 410, 420 disclosed herein are released from a launching apparatus 200 located remotely from the work string 146, such as the rig floor 126 or another remote location, to travel through the tortuous path provided by the fluid delivery line 122 into the swivel 300. By the time these mechanical plugs 410, 420 reach the swivel 300, they may have traversed a flowpath that changed elevation, diameters, and direction a number of times. Because this flowpath is a tortuous path comprising multiple obstacles, the use of conventional darts would be unsuitable for the methods disclosed herein because such conventional darts would become stuck inside the tortuous path presented by the fluid delivery line 122 and/or become damaged by traversing the obstacles presented therein.

Figure 4:
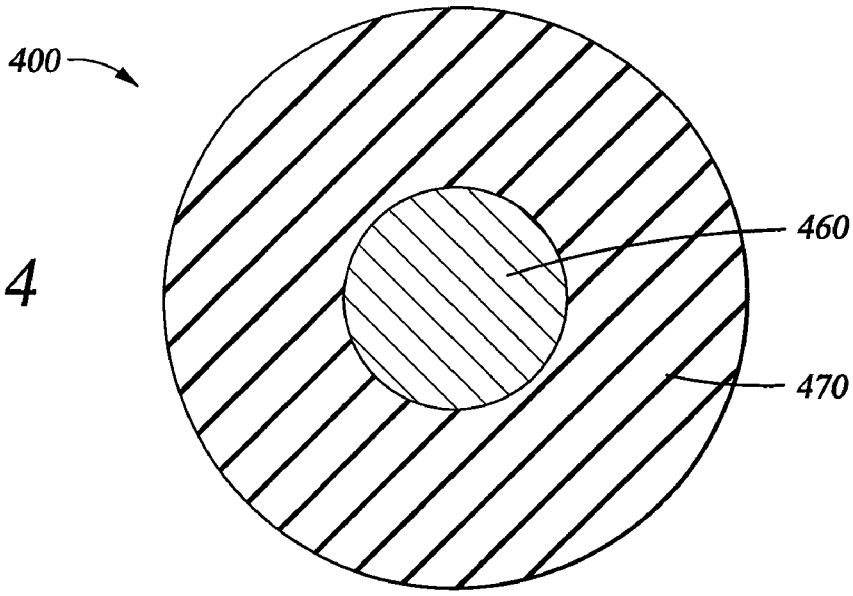
FIG. 4 schematically depicts one embodiment of a mechanical plug.

To address such limitations, FIG. 4 illustrates one embodiment of a spherical mechanical plug 400 designed to actuate a downhole tool, wipe pipe surfaces, and/or separate fluids, and be launched from the remote launching apparatus 200. The spherical mechanical plug 400 is operable to traverse the tortuous flowpath from the remote launching apparatus 200, along the fluid delivery line 122, through the valve 120 and the cementing swivel 300, and to its final destination inside the work string 146. The spherical mechanical plug 400 can traverse this tortuous flowpath without becoming stuck in route due to constrictions, corners, and bends, and without becoming so damaged that it fails to perform its intended task of actuating a downhole tool, such as cementing plugs 150, 152.

The spherical mechanical plug 400 comprises a spherical solid core 460 surrounded by a concentric flexible layer 470. The solid core 460 is constructed from any material suitable for use in a well bore environment, including, but not limited to plastics, phenolics, composite materials, high strength thermoplastics, wood, glass, metals such as aluminum or brass, or combinations thereof. If the spherical mechanical plug 400 is intended to actuate a particular downhole tool, the size of the solid core 460 is designed to seat on that downhole tool and also pass through any constrictions in the tortuous flowpath, such as the interior of valves as well as corners and bends. The thickness of the flexible layer 470 is determined based upon the internal diameter of the work string 146 and tubular 148 such that the flexible layer remains substantially in contact with the surrounding pipe wall as the spherical mechanical plug 400 travels. The flexible layer 470 may be constructed from any flexible material having sufficient density, firmness and resilience to resume approximately its original shape after passing through a constriction. Such flexible materials include, but are not limited to, natural rubber, nitrile rubber, styrene butadiene rubber, polyurethane, or combinations thereof. As the spherical mechanical plug 400 travels along the flowpath from the remote launching apparatus 200 to its final destination inside the work string 146, the mass of the solid core 460 prevents the spherical mechanical plug 400 from becoming stuck when the flowpath changes direction, while the flexible layer 470 repeatedly compresses and expands through constrictions to remain in contact with the surrounding pipe wall. Substantially regular contact between the flexible layer 470 and the surrounding pipe wall surfaces permits the spherical mechanical plug 400 to effectively wipe the pipe wall surfaces and/or separate the fluid ahead of the spherical mechanical plug 400 from the fluid following the spherical mechanical plug 400. Upon arriving at its final destination, the mass of the solid core 460 permits the spherical mechanical plug 400 to exert sufficient force to actuate a downhole tool.

Figure 5:
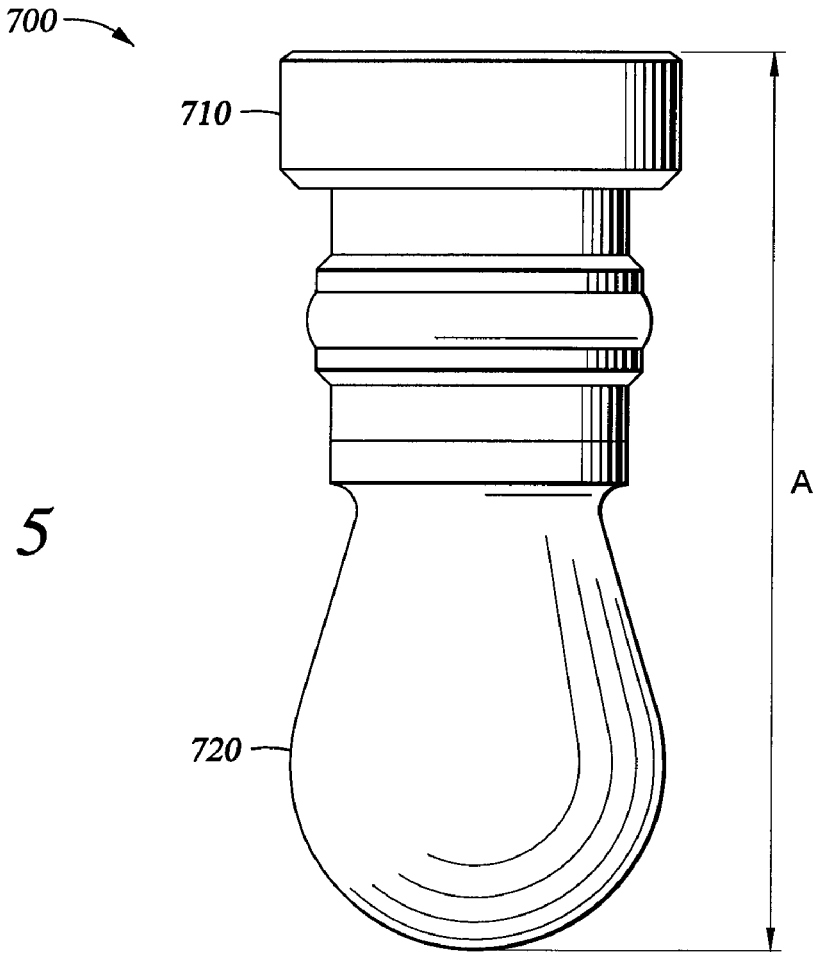
FIG. 5 schematically depicts another embodiment of a mechanical plug.

FIG. 5 illustrates another embodiment of a teardrop-shaped mechanical plug 700. Like the spherical mechanical plug 400, this embodiment also comprises a solid portion 710 and a flexible portion 720. In this embodiment, however, the flexible portion 720 is not concentrically disposed about the solid portion 710. Instead, the flexible portion 720 is disposed at the lower end of the plug and comprises the "fat" end of the teardrop shape. Once released by the remote launching apparatus 200, the teardrop-shaped mechanical plug 700 travels along its flowpath with the flexible portion 720 leading and pulling the solid portion 710. Although the teardrop-shaped mechanical plug 700 is shaped differently than the spherical mechanical plug 400 of FIG. 4, the function of the teardrop-shaped mechanical plug 700, as well as the functions of the solid portion 710 and the flexible portion 720 may be the same. The material compositions of the solid portion 710 and the flexible portion 720 may be the same or different than the solid core 460 and the flexible layer 470, respectively. Unlike the spherical mechanical plug 400, however, the teardrop-shaped mechanical plug 700 has a length, indicated by the letter "A" in FIG. 5, which if not properly designed may cause the teardrop-shaped mechanical plug 700 to become unstable or stuck. To prevent this from occurring, the length "A" of the teardrop-shaped mechanical plug 700 must be greater than the internal diameter of the largest constriction through which the teardrop-shaped mechanical plug 700 will pass, but not so long that the teardrop-shaped mechanical plug 700 will get stuck as it traverses corners and bends. In an embodiment, the length "A" of the teardrop-shaped mechanical plug 700 is at least 1.25 times greater than the diameter of the internal diameter of the largest constriction through which the teardrop-shaped mechanical plug 700 will pass. Appropriately sizing length "A" will prevent the teardrop-shaped mechanical plug 700 from becoming inverted and stuck inside the fluid delivery line 122 or the work string 146.

While various embodiments have been shown and described, modifications thereof can be made by one skilled in the art without departing from the spirit or teaching of this disclosure. The embodiments described herein are exemplary only and are not limiting. Many variations and modifications of the apparatus and methods are possible and are within the scope of the disclosure. Accordingly, the scope of protection is not limited to the embodiments described herein, but is only limited by the claims that follow, the scope of which shall include all equivalents of the subject matter of the claims.

What we claim as our invention is:

1. A system for actuating a downhole tool disposed within a work string comprising:

a support suspending the work string into a well bore;

a launching apparatus positioned at a location remote from the work string;

a tortuous path connected between the launching apparatus and the work string; and a mechanical plug that launches from the launching apparatus, traverses the tortuous path, enters the work string, and actuates the downhole tool, wherein the mechanical plug may be loaded within the launching apparatus while a fluid continues to flow through the launching apparatus.

2. The system of claim 1 further comprising a top drive unit that selectively rotates the work string.

3. The system of claim 1 wherein the work string comprises a flag sub that provides a visual indication when the mechanical plug passes therethrough.

4. The system of claim 1 wherein the support is a derrick on a drilling rig.

5. The system of claim 1 wherein the launching apparatus comprises:

a throughbore that houses the mechanical plug;

a launch valve having a hold position that prevents the mechanical plug from launching and a release position that allows the mechanical plug to launch into the tortuous path;

a by-pass loop that extends around at least a portion of the throughbore; and a by-pass valve having a closed position that prevents a fluid flow through the by-pass loop and an open position that allows a fluid flow through the by-pass loop.

6. The system of claim 5 further comprising a supply pump providing fluid flow to the launching apparatus.

7. The system of claim 1 further comprising a swivel connecting the tortuous path to the work string.

8. The system of claim 7 wherein the swivel comprises:

an outer housing with a fluid port extending through a wall thereof in communication with the tortuous path;

an inner mandrel with a fluid channel extending through a wall thereof and connected to a mandrel throughbore in communication with the work string;

wherein the inner mandrel is rotationally disposed within the outer housing; and wherein the fluid port and the fluid channel are alignable to receive the mechanical plug.

9. The system of claim 8 wherein the outer housing and the inner mandrel are rotationally lockable to maintain alignment between the fluid port and the fluid channel.

10. The system of claim 8 wherein the inner mandrel further comprises a plurality of fluid apertures extending through the wall thereof and connected to the mandrel throughbore.

11. The system of claim 1 wherein the tortuous path comprises at least one constriction.

12. The system of claim 11 wherein the at least one constriction comprises a bend, a corner, a valve, a flange connection, a change in pipe diameter, an orifice, or a combination thereof.

13. The system of claim 1 wherein the mechanical plug comprises:

a flexible portion that expands and contracts to maintain substantially constant contact with a surrounding wall as the device traverses the tortuous path and the work string; and a solid portion that actuates the downhole tool.

14. The system of claim 13 wherein the mechanical plug further comprises a spherical or teardrop shape.

15. The system of claim 1 wherein the launching apparatus is non-load bearing.

16. The system of claim 15 wherein the launching apparatus does not support the weight of the work string.

17. The system of claim 1 wherein the launching apparatus does not transmit torque.

18. The system of claim 1 wherein the launching apparatus does not allow rotation therethrough.

19. The system of claim 1 wherein the downhole tool is a cementing plug.

20. The system of claim 1 wherein the remote location is on or adjacent a rig floor.

21. A system for actuating a downhole tool disposed within a work string comprising:

a support suspending the work string into a well bore;

a launching apparatus positioned at a location remote from the work string;

a tortuous path connected between the launching apparatus and the work string;

a mechanical plug that launches from the launching apparatus, traverses the tortuous path, enters the work string, and actuates the downhole tool; and a top drive unit that selectively rotates the work string.

22. A system for actuating a downhole tool disposed within a work string comprising:

a support suspending the work string into a well bore;

a launching apparatus positioned at a location remote from the work string;

a tortuous path connected between the launching apparatus and the work string;

a mechanical plug that launches from the launching apparatus, traverses the tortuous path, enters the work string, and actuates the downhole tool, and wherein the work string comprises a flag sub that provides a visual indication when the mechanical plug passes therethrough.

23. A system for actuating a downhole tool disposed within a work string comprising:

a support suspending the work string into a well bore;

a launching apparatus positioned at a location remote from the work string, wherein the launching apparatus comprises:

a throughbore that houses the mechanical plug;

a launch valve having a hold position that prevents the mechanical plug from launching and a release position that allows the mechanical plug to launch into the tortuous path;

a by-pass loop that extends around at least a portion of the throughbore; and a by-pass valve having a closed position that prevents a fluid flow through the by-pass loop and an open position that allows a fluid flow through the by-pass loop;

a tortuous path connected between the launching apparatus and the work string; and a mechanical plug that launches from the launching apparatus, traverses the tortuous path, enters the work string, and actuates the downhole tool.

24. The system of claim 23 further comprising a supply pump providing fluid flow to the launching apparatus.

25. A system for actuating a downhole tool disposed within a work string comprising:

a support suspending the work string into a well bore;

a launching apparatus positioned at a location remote from the work string;

a tortuous path connected between the launching apparatus and the work string;

a mechanical plug that launches from the launching apparatus, traverses the tortuous path, enters the work string, and actuates the downhole tool; and a swivel connecting the tortuous path to the work string.

26. The system of claim 25 wherein the swivel comprises:

an outer housing with a fluid port extending through a wall thereof in communication with the tortuous path;

an inner mandrel with a fluid channel extending through a wall thereof and connected to a mandrel throughbore in communication with the work string;

wherein the inner mandrel is rotationally disposed within the outer housing; and wherein the fluid port and the fluid channel are alignable to receive the mechanical plug.

27. The system of claim 26 wherein the outer housing and the inner mandrel are rotationally lockable to maintain alignment between the fluid port and the fluid channel.

28. The system of claim 26 wherein the inner mandrel further comprises a plurality of fluid apertures extending through the wall thereof and connected to the mandrel throughbore.

29. A system for actuating a downhole tool disposed within a work string comprising:

a support suspending the work string into a well bore;

a launching apparatus positioned at a location remote from the work string;

a tortuous path comprising at least one constriction and connected between the launching apparatus and the work string; and a mechanical plug that launches from the launching apparatus, traverses the tortuous path, enters the work string, and actuates the downhole tool.

30. The system of claim 29 wherein the at least one constriction comprises a bend, a corner, a valve, a flange connection, a change in pipe diameter, an orifice, or a combination thereof.

31. A system for actuating a downhole tool disposed within a work string comprising:

a support suspending the work string into a well bore;

a launching apparatus positioned at a location remote from the work string;

a tortuous path connected between the launching apparatus and the work string; and a mechanical plug that launches from the launching apparatus, traverses the tortuous path, enters the work string, and actuates the downhole tool, wherein the mechanical plug comprises a flexible portion that expands and contracts to maintain substantially constant contact with a surrounding wall as the device traverses the tortuous path and the work string.

32. The system of claim 31 wherein the mechanical plug further comprises a spherical or teardrop shape.

* * * * *